US006371427B1

(12) United States Patent
Johnson

(10) Patent No.: US 6,371,427 B1
(45) Date of Patent: Apr. 16, 2002

(54) WALL MOUNTED HANGER

(76) Inventor: James R. Johnson, 447 47th St., Astoria, OR (US) 97103-2204

( * ) Notice: Subject to any disclaimer, the term of this patent is extended or adjusted under 35 U.S.C. 154(b) by 0 days.

(21) Appl. No.: 09/561,983

(22) Filed: May 2, 2000

(51) Int. Cl.[7] ..... A47H 1/16
(52) U.S. Cl. ..... 248/303; 248/218.2
(58) Field of Search ..... 248/303, 302, 248/218.1, 218.2, 218.3, 262, 254, 249, 267; D8/370

(56) References Cited

U.S. PATENT DOCUMENTS

| | | | | |
|---|---|---|---|---|
| 229,873 | A | * | 7/1880 | Day |
| 300,167 | A | * | 6/1884 | Unangst |
| 392,222 | A | * | 11/1888 | Parmelee |
| 411,307 | A | * | 9/1889 | Turner |
| 698,227 | A | * | 4/1902 | Schrader |
| 806,141 | A | * | 12/1905 | Henson |
| 808,142 | A | * | 12/1905 | Danhour |
| 1,445,372 | A | * | 2/1923 | Wagner |
| 1,519,074 | A | * | 12/1924 | Torrence |
| 1,665,785 | A | * | 4/1928 | Illch |
| 3,219,302 | A | | 11/1965 | Smith ..... 248/220 |
| 3,273,844 | A | | 9/1966 | Hodson et al. ..... 248/217 |
| 3,312,442 | A | | 4/1967 | Moeller ..... 248/217 |
| 4,103,854 | A | | 8/1978 | Plimi et al. ..... 248/235 |
| 4,485,995 | A | | 12/1984 | Hogg ..... 248/218 |
| 4,509,713 | A | * | 4/1985 | Hogg |
| 4,619,430 | A | | 10/1986 | Hogg ..... 248/467 |
| 4,728,070 | A | * | 3/1988 | Engelbrecht |
| 5,149,037 | A | | 9/1992 | Smith ..... 248/216 |

* cited by examiner

*Primary Examiner*—Ramon O. Ramirez
*Assistant Examiner*—Korie H. Chan
(74) *Attorney, Agent, or Firm*—James D. Givnan, Jr.

(57) ABSTRACT

A wall mounted hanger is of flexible wire construction including arcuate wire segments for insertion through an opening in the wall for endwise wall contact. The wire segments oppositely extend through the wall and merge with upwardly curved wire segments to form a hook. A modified wall hanger further includes multiple vertically spaced hooks supported by a wall and a wall abutting plate and fasteners for wall insertion. A still further modification includes wire segments extending outwardly from a wall and forming juxtaposed hooks for reception of a curtain or drapery rod with wire segments continuing to form a brace supported by a wall abutting plate.

2 Claims, 4 Drawing Sheets

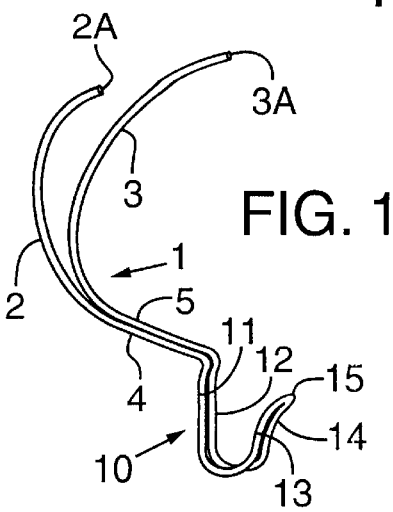
FIG. 1
FIG. 2
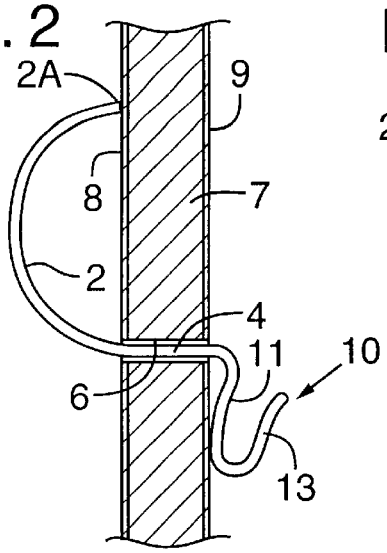
FIG. 3
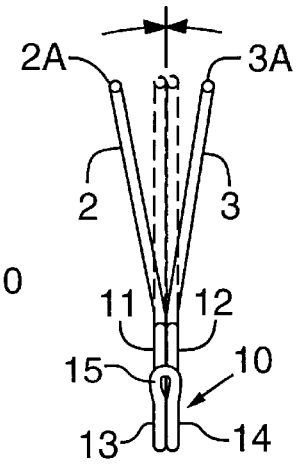
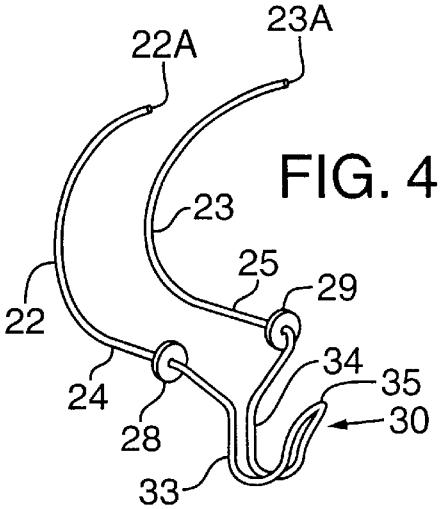
FIG. 4
FIG. 5
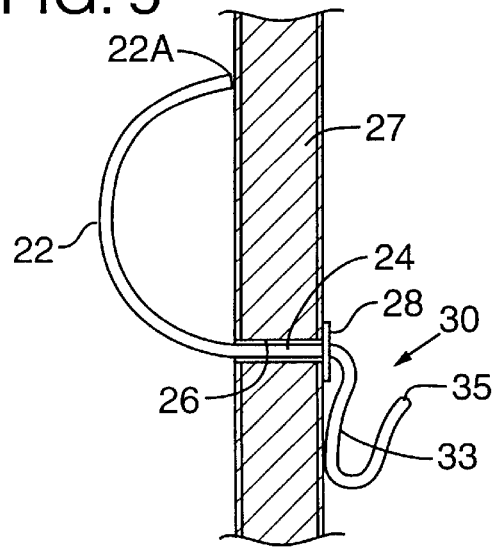
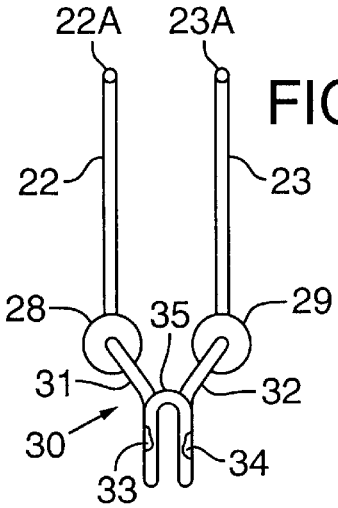
FIG. 6

WALL MOUNTED HANGER

BACKGROUND OF THE INVENTION

The present invention concerns hangers of wire construction for installation on an interior wall of a structure.

Hangers for use in the home or other buildings often include expansible members for insertion through a wall opening for load bearing contact with the back or inner side of a wall. Such hangers require a somewhat large opening to be made in the wall. Further, their installation requires some degree of skill and are not easily removed from a wall. Other wall hanger devices utilize wall inserted collets inserted into an oversize opening and which expand into load bearing contact with the wallboard or gypsum board. Other wall mounted hangers require insertion into a wall stud necessitating a certain degree of skill.

Complicating the installation and use of wall hangers is the apparently lessening quality of sheet rock (gypsum board) wall material which are presently manufactured from waste or reclaimed wallboard material. A still further drawback to know expansible wall hangers is the problem of removing a permanently mounted expansible hanger which typically entails the resurfacing of the opening area.

U.S. Pat. No. 3,219,302 discloses a wall hanger of "stiff yet flexible wire construction" having an irregular inserted segment, a horizontal segment or segments for wall installation and exteriorly disposed vertical and horizontal segments. A further form of the wall hanger terminates in a hook. The short radius bends of the hanger would result in insertion of the hanger through a wall necessitating a wall opening of objectionable size. Further, the right angular bends of the hanger would tend to render any hole formed by insertion of the bends unsightly.

U.S. Pat. No. 3,312,442 discloses an insertable wall hanger of plate stock requiring a tubular sleeve be inserted in the wall opening.

U.S. Pat. No. 3,273,844 discloses a wall hanger or display hook for use on corrugated cardboard with large, flat load disbursing surfaces with one of said surfaces being insertable through a slot defined by the cardboard. A projection or tooth also penetrates the cardboard.

U.S. Pat. No. 4,103,854 discloses a wall mounted hanger of one piece construction having an upper end for abutment with the back side of a wall and requires a wall opening of unusual configuration with a reduced area for cooperation with a canted arm having an end for locked engagement with the area defining edges. The wall hanger is designed for use with thin panels backed by foamed insulation material. The one piece device is of thermoplastic material.

U.S. Pat. No. 4,485,995 discloses a wall hanger having a single wall penetrating angular or curved portion terminating in engagement with the back side of a wall with a straight segment received within a wall opening. A plate member for contact with the frontal wall surface has a hook formed at its lower end. The shaped wire component is formed from a single run of wire stock.

U.S. Pat. No. 4,619,430 discloses a wire hanger having a curved segment for contact with the back side of a wall and a downwardly turned exterior wire segment secured to a wall plate having a hook at its lower end, U.S. Pat. No. 5,149,037 discloses a one piece wall hanger having a curved portion for wall insertion and abutment. A wall engaging pin is carried by an exposed portion of the molded hanger.

SUMMARY OF THE PRESENT INVENTION

The present invention is embodied in wall hanger construction wherein wire is shaped to support a wide range of loads particularly on wall material commonly used in home construction In one embodiment of the invention, a light gauge length of flexible wire is formed with a pair of arcuate segments for endwise abutment at spaced apart points with the back side of a wall. Juxtaposed straight segments occupy a wall aperture while depending straight segments are for rested engagement against the front side of the wall. Curved segments of hanger wire terminate or merge with one another at a reverted extremity of the hanger.

A heavy duty wall hanger, for example, for the support of a mirror on a wall, includes a hanger of medium gauge wire wherein arcuate segments each penetrate the wall through a separate aperture and terminate at their ends in endwise abutment with the back side of the wall. Discs on wall located straight segments of the hanger protect the wall surface and serve to reinforce the straight segments.

A further embodiment of the invention includes a wall hanger where arcuate wall segments are located rearwardly of a wall and in abutment therewith with straight segments extending through the wall and through a plate component. The two wire segments are outwardly and upwardly curved to form a first hook and subsequently are directed downwardly toward the wall surface and then again curved upwardly to provide a second or supplemental hook. Fastener means secure the second hook against applied loads.

A still further form of the wall hanger includes a pair of arcuate segments for endwise abutment with the back side of a wall with straight segments occupying separate apertures in the wall and extending outwardly therefrom and merging with hook segments of generally semicircular configuration. Continuing wire segments project downwardly and toward the wall surface to form a brace for the curved hook segments and ultimately are secured to a plate by fastening means which may protrude into the wall surface to stabilize the hanger. The hook segments may be dimensioned to receive curtain or drapery rods typically an inch or so in diameter.

A further form of hanger is adapted to support a closet or curtain rod and includes reverted wire segments and semicircular wire segments the latter receiving a rod end. Each semicircular wire segment merges with brace segments which form an eye for screw reception.

Important objectives of the present invention include the provision of a wall hanger suitable for small and medium sized articles which is made from low cost wire and installed through a single aperture in a wall member to provide spaced apart points of contact with the wall for optimum strength; the provision of a wall hanger of light gauge wire which includes arcuate segments which may be displaced toward one another for wall insertion through a single wall opening to minimize disfigurement of a wall surface; the provision of a wall hanger of medium gauge wire having arcuate segments each for penetration of the wall through separate apertures with the hanger reinforced by discs in abutment with the front side of the wall; the provision of a wall hanger having multiple hooks thereon particularly suited for supporting clothing and hats, and including a plate structure disbursing load imparted forces over the frontal surface of the wall with arcuate segments of the hanger in abutment with the rear surface of the wall; the provision of a hanger particularly suited for supporting curtain or drapery rods and having arcuate segments terminating in wall abutment and also forwardly projecting straight segments merging into curved hook segments for reception of a curtain or drapery rod. A continuation of the wire segments projects downwardly and rearwardly toward the wall surface and thereat receives a fastener securing a reverted portion of the hanger to a wall abutting plate.

BRIEF DESCRIPTION OF THE DRAWINGS

In the accompanying drawings:

FIG. 1 is a perspective view of a wall hanger formed from flexible light gauge wire;

FIG. 2 is a side elevational view of the hook shown in FIG. 1 in place on a sectioned wall;

FIG. 3 is a front elevational view taken from the right hand side of FIG. 2 with the wall removed and illustrating the flexible feature of the wall hanger;

FIG. 4 is a perspective view of a modified wall hanger;

FIG. 5 is a side elevational view of the wall hanger shown in FIG. 4 operatively disposed on a wall section;

FIG. 6 is an elevational view taken from the right hand side of FIG. 5 with the wall removed;

DETAILED DESCRIPTION OF THE PREFERRED EMBODIMENTS

Figure 7:
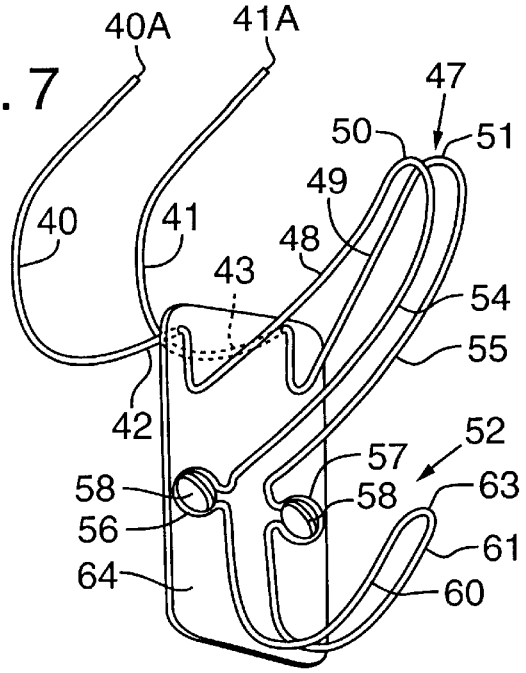
FIG. 7 is a perspective view of a modified form of the wall hanger showing multiple hooks.

With continuing attention to the drawings wherein reference numerals indicate parts similarly hereinafter identified, the reference numeral 1 indicates generally a wall hanger constructed from light gauge wire preferably of steel and approximately 1/32th of an inch diameter.

Arcuate wire segments at 2 and 3 each terminate at ends 2A and 3A while oppositely the wire segments merge into straight segments at 4 and 5. The wire is formed so that straight segments 4 and 5 are juxtaposed to permit insertion into a small aperture 6 in a wall 7 which, in contemporary homes, is usually sheet rock or gypsum board having a mineral composition with paper inner and outer surfaces 8 and 9. The juxtaposed straight segments 4 and 5 continue outwardly to form a hook generally at 10 having juxtaposed depending segments 11 and upwardly directed segments 13 and 14, both of which terminate in a 180 degree bend or reverted segment 15. As shown in FIG. 2, the depending straight segments 11 and 12 rest in contact with wall surface 9 and held thereagainst by the action of arcuate members 2 and 3.

For installation of hanger 1 and with reference to FIG. 3, the arcuate segments 2 and 3 are momentarily biased to the broken line position by fingertip pressure to enable insertion of the segments through a relatively small wall opening 6. Upon passage through the openings the segments 2 and 3 as inherently shaped during manufacture will assume their normal spaced apart positions shown in FIG. 1 with segments ends 2A–3A in biased contact with back wall surface 8. The flexible nature of the wire allows flexing of arcuate segments 2 and 3 during insertion through opening 6. The juxtaposed wire segments at 4, 5 and 11, 12 will bear respectively upon the surfaces in opening 6 and front wall 9. Extraction of the hanger is achieved by upward and outward rotation of hook portion 10 which draws arcuate segments 2 and 3 through opening 6.

With attention now to a modified hook shown in FIG. 4, the same is constructed from somewhat heavier gauge wire approximately 3/32 of an inch in diameter and is best suited for the support of heavy articles such as mirrors and large framed pictures. Arcuate segments at 22 and 23 each terminate at ends 22A and 23A with the segments merging with straight segments 24 and 25 for disposition in wall openings as at 26. Discs at 28 and 29 are each apertured to admit wire passage. A hook portion generally at 30 includes downwardly convergent wire segments 31 and 32 which merge with straight segments 33, 34 of hook portion 30. An upwardly directed reverted bend is at 35. Hook portion 30 transfers a load to wall 27 defining openings 26 which receives straight runs 24 and 25 of the hanger while discs as at 28 bear against the outer or front wall surface.

Figure 8:
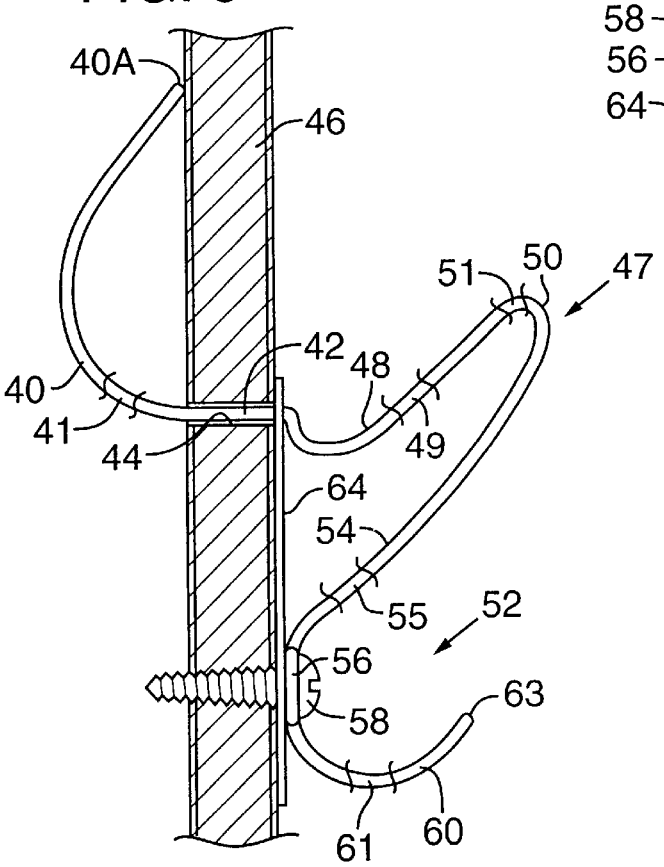
FIG. 8 is a side elevational view of the hook shown in FIG. 7 operatively disposed in a wall section.
Figure 9:
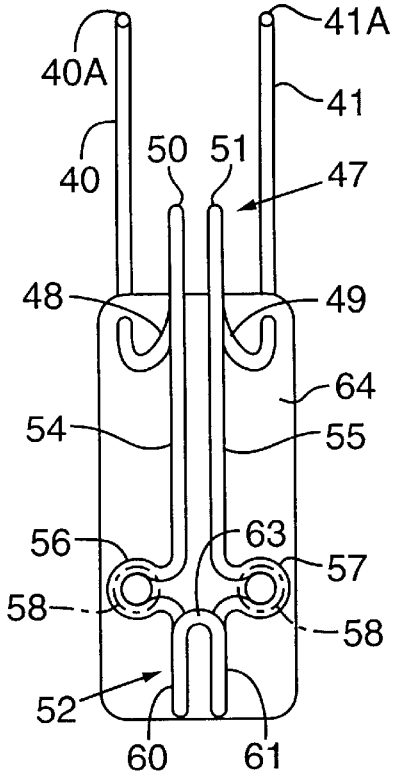
FIG. 9 is a front elevational view taken from the right hand side of FIG. 8 with the wall removed.

With attention to FIGS. 7 through 9 a wall hanger is disclosed, which may termed a clothes hanger in that it is suited for the support of multiple articles such as clothing and headwear. Arcuate segments of wire are shown at 40 and 41 with ends at 40A and 41A for wall contact. Segments 40 and 41 merge downwardly with straight segments as at 42 and 43. A first hook portion generally at 47 of the hanger includes wire segments at 48 and 49 which terminate outwardly and upwardly in reverted bends 50 and 51. A second or supplemental hook portion indicated generally at 52 includes inclined wire segments 54 and 55 which terminate eyelets at 56 and 57 each receiving fasteners 58. Upwardly curved segments 60 and 61 merge to form a reverted bend 63. Contributing to hanger strength is a plate 64 apertured to receive fasteners 58.

Figure 10:
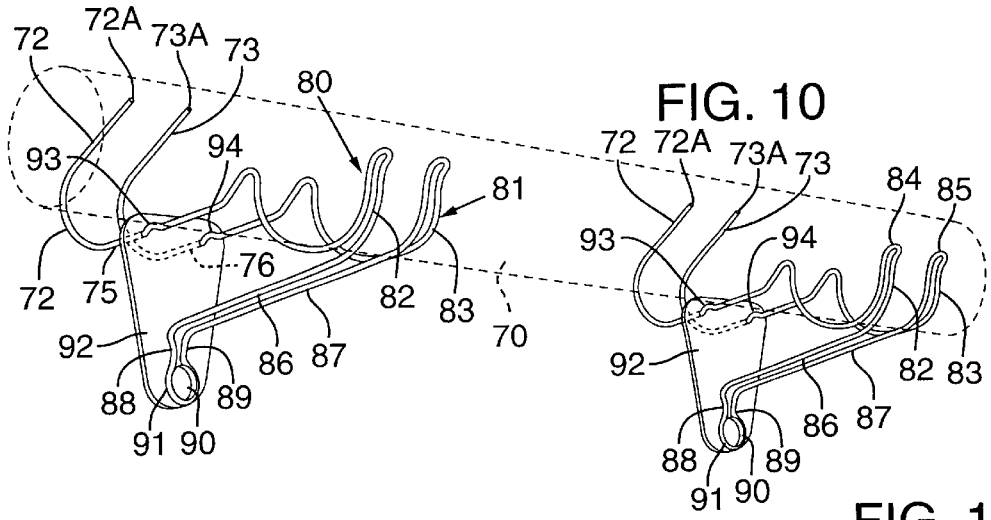
FIG. 10 is a perspective view of a wall hanger operatively disposed supporting a drapery rod on a wall not show.
Figure 11:
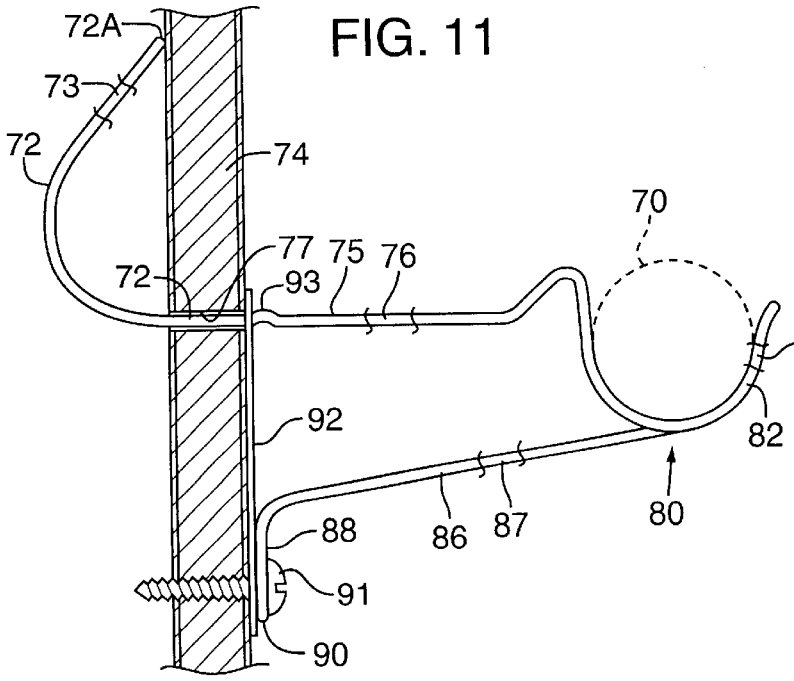
FIG. 11 is a side elevational view of one of the hangers shown in FIG. 10 in place within a supporting wall section.
Figure 12:
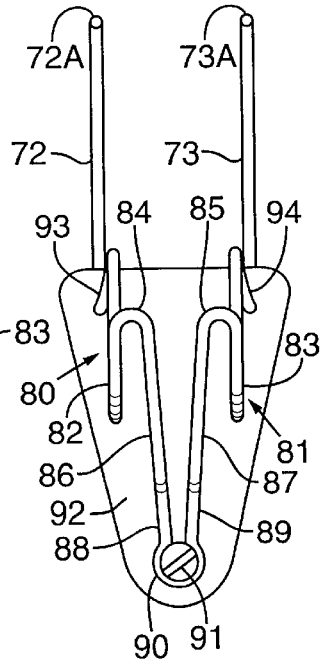
FIG. 12 is an elevational view of the wall hanger shown in FIG. 11 taken from the right hand side thereof removed from the wall.

In FIGS. 10 through 12, a wall hanger is shown for the support of a curtain or drapery rod 70. The modified form of wall hanger includes arcuate segments 72 and 73 which terminate at ends 72A and 73A for contact with the back side of a wall 74. Straight segments at 75 and 76 extend forwardly through a pair of wall openings as at 77. The straight segments 75 and 76 project forwardly to form hooks generally at 80 and 81. Each hook portion 80 and 81 includes upwardly curved segments 82 and 83 terminating in reverted bends 84 and 85. For bracing of the hook portions of the hanger, inclined wire segments at 86 and 87 each serve as a brace and terminate in angular end segments 88, 89 which merge to form an eyelet 90 for reception of a fastener 91. A plate 92 for wall abutment may serve as a template when removed from the wire segments for marking of a wall for drilling or punching of openings therethrough. Further, the plate serves to support hooks 80 and 81 against loads imparted by curtain or drape supporting rod 70. Offsets at 93, 94 in each straight segment 75–76 confine plate 92 in place against a frontal surface of wall 74.

Figure 13:
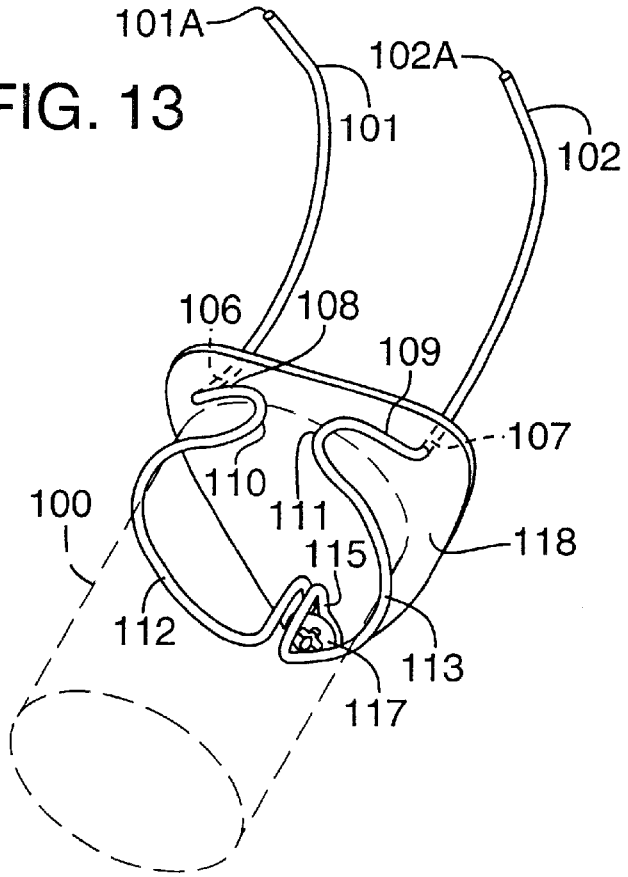
FIG. 13 is a downward perspective view of a modified hanger for closet and curtain rods.
Figure 14:
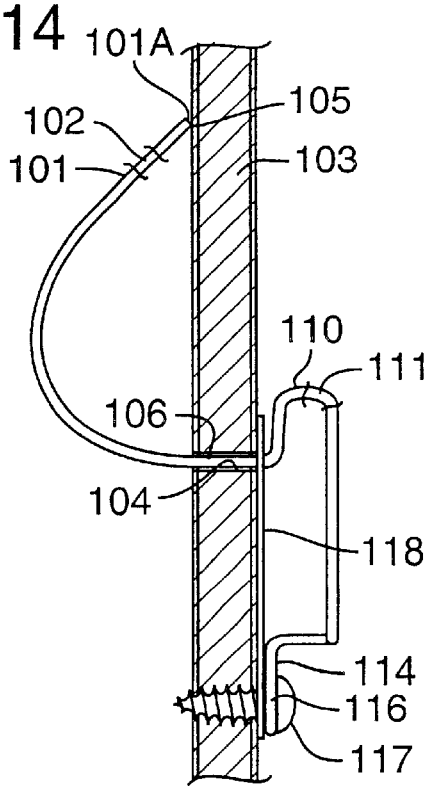
FIG. 14 is a side elevational view of the hanger of FIG. 13 in place on a wall.
Figure 15:
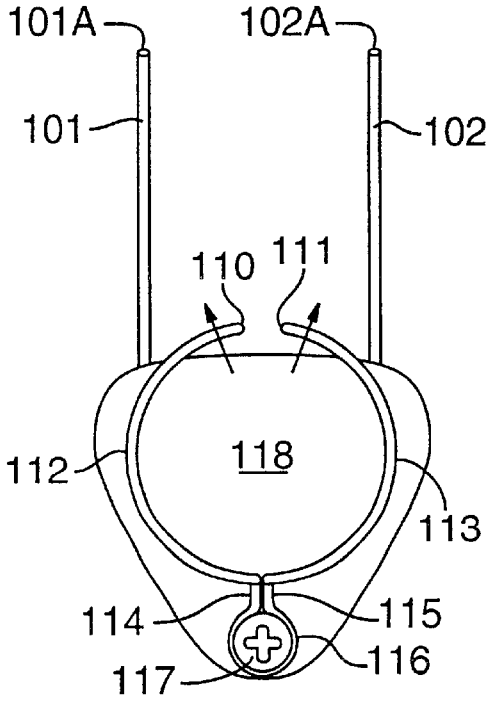
FIG. 15 is a front elevational view of FIG. 13.

In FIG. 13, a wall hanger is shown for the support of a closet or curtain rod of circular cross section at 100. Arcuate hanger segments at 101 and 102 terminate at ends 101A and 102A. When installed in a wall 103, provided with spaced apart openings as at 104 the ends abut the inner or back side of the wall at 105. Each arcuate segment respectively merges with a straight wire segment at 106 and 107 which in turn terminate in upwardly directed curved wire segments 108 and 109. Reverted wire segments at 110 and 111 merge with upright semicircular segments at 112 and 113 formed on a radius to receive rod 100 and merge at their lower ends with brace segments as at 114 and 115. The last mentioned segments extend to jointly form an eye 116 for the reception of a screw fastener 117. A wall abutting plate 118 is apertured to receive a fastener 117 and, adjacent the plate upper edge, defines a pair of apertures through which extend straight wire segments 106 and 107. Rod imparted loads to the hanger are borne by fastener 117 and plate 118 which transfers such loads to wire straight segments 106, 107 and to arcuate segments 101 and 102. To facilitate lateral insertion of a curtain or closet rod reverted wire segments 110 and 111 may be tangential, i.e., bent upwardly per the arrows of FIG. 14 to facilitate downward rod insertion.

While I have shown but a few embodiments of the invention, it will be apparent to those skilled in the art that the invention may be embodied still otherwise without departing from the spirit and scope of the invention.

Having thus described the invention, what is desired to be secured by a Letters Patent is:

I claim:

1. A wall hanger of flexible wire for attachment to a wall and comprising, a plate for abutment with the wall, arcuate flexible wire segments each for individual insertion through a wall defined aperture and terminating in an end for abutment with an inner surface of the wall, wall insertable straight segments each for individual disposition respectively in a wall defined aperture segments and projecting away from said arcuate flexible wire segments, and each individually integral with one of said arcuate flexible wire segments and projecting away from said arcuate flexible wire segments, hooks carried by the straight segments for receiving an article to be supported and each of said hooks having an upwardly directed curved wire segment and a reverted wire segment, and inclined wire segments integral with and supporting said hooks and terminating to form an eye in abutment with said plate for reception of a fastener.

2. The hanger claimed in claim 1 wherein said wall insertable straight segments extend in a horizontal manner outwardly from said plate and toward said hooks.

* * * * *